US007497438B2

(12) United States Patent
Stemmle

(10) Patent No.: US 7,497,438 B2
(45) Date of Patent: Mar. 3, 2009

(54) BOTTOM DISK STACKER EMPLOYING A SLOTTED DISK TO STACK SHEET MATERIAL

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 790 days.

(21) Appl. No.: 10/896,394

(22) Filed: Jul. 22, 2004

(65) Prior Publication Data

US 2006/0017220 A1 Jan. 26, 2006

(51) Int. Cl.
*B65H 29/20* (2006.01)

(52) U.S. Cl. ..... 271/315; 271/212

(58) Field of Classification Search ..... 271/212, 271/315, 187, 4.1; 194/206, 207; 209/534
See application file for complete search history.

(56) References Cited

U.S. PATENT DOCUMENTS 4,511,136 A * 4/1985 Yamada et al. ..... 271/187
4,618,302 A 10/1986 Kokubo et al. ..... 414/33
4,638,993 A * 1/1987 Granzow et al. ..... 271/315
5,026,036 A * 6/1991 Takahashi ..... 271/3.03
5,201,504 A * 4/1993 Fallos et al. ..... 271/2
5,430,664 A * 7/1995 Cargill et al. ..... 194/207
5,620,177 A * 4/1997 Takemoto et al. ..... 271/176
5,803,705 A * 9/1998 Keyes ..... 414/793.9
5,898,650 A * 4/1999 Porsbo et al. ..... 369/30.89
6,302,393 B1 * 10/2001 Beskitt et al. ..... 271/258.01
6,494,447 B2 * 12/2002 Myer, Sr. ..... 271/176
6,796,557 B2 * 9/2004 Watanabe et al. ..... 271/176

FOREIGN PATENT DOCUMENTS

GB 2168687 A * 6/1986
WO WO 00/15530 3/2000
WO WO 00/43307 7/2000

* cited by examiner

*Primary Examiner*—Patrick H Mackey
*Assistant Examiner*—Gerald W McClain
(74) *Attorney, Agent, or Firm*—Brian A. Collins; Angelo N. Chaclas

(57) ABSTRACT

A bottom stacker having a pair of slotted disks to receive incoming mail pieces one at a time from an input nip. The mail pieces are separately placed in the slots and carried by the rotation of the disks to a stack support in the stacker. The stack support is disposed at a small angle from the vertical axis so that the mail pieces in the stack are kept in the stack by gravity. When a new mail piece is carried in a slot toward the stack support, the lead edge of the mail piece is stopped by a stopping surface so as to disengage the mail piece from that slot. As the disks rotate further, part of the outer periphery of the disks moves the disengaged mail piece toward the stack so as to deposit the mail piece at the bottom of the stack.

5 Claims, 10 Drawing Sheets

BOTTOM DISK STACKER EMPLOYING A SLOTTED DISK TO STACK SHEET MATERIAL

CROSS REFERENCES TO RELATED APPLICATIONS

The present invention is related to U.S. patent application Ser. No. 10/896,824, assigned to the assignee of the present invention, filed even date herewith.

FIELD OF THE INVENTION

The present invention relates generally to a mail stacker and, more specifically, to a bottom stacker.

BACKGROUND OF THE INVENTION

A mail stacker is usually a part of a mailing machine, addressing equipment or mail creation equipment. Mail stackers can be classified into two types: top stackers and bottom stackers. In a top stacker, a later mail piece is stacked on top of the earlier ones. In a bottom stacker, a later mail piece is placed at the bottom part of the stack. In some applications such as addressing and inserting systems, mail pieces are required to be stacked in a certain serial order. For example, mail pieces are required to be stacked in a forward serial order in order to be eligible for a postal discount. The addressing information is often printed on top of the mail pieces.

For mail pieces printed in a 1-to-N order, the topmost mail piece in a mail stack having a forward serial order is always printed earlier than the rest of the stack. However, top stackers will reverse the order of the mail pieces to an N-to-1 order while stacking. In order to keep a forward serial order when using a top stacker, an application software can be used to reverse the serial order when addressing. The use of order-reversing software adds considerable complexity to the mail processing system, especially for jam recovery.

Thus, in a mail system requiring a forward serial order, it is advantageous and desirable to use a bottom stacker to reverse the serial order while stacking.

Bottom stackers are known in the art. For example, Keane et al. (U.S. Pat. No. 6,398,204 B1) discloses a belt stacker wherein mail pieces are separately fed by an edge feeder to a stacking deck on the edge of the stacker at the upstream end of the stacking deck. The mail pieces already in the stack are moved by a conveyer belt toward the downstream, away from the edge feeder. At the same time, a stack support is used to keep the stacked mail pieces in an upright position while they are moved downstream. The stack support must be moved toward the downstream end to allow additional room for the stack to grow. In Keane et al., the stack support is either manually relocated or moved by the conveyor belt. Marsullo et al. (U.S. Pat. No. 5,709,525) also discloses a bottom stacker, wherein a pusher mechanism is used for sealing the incoming envelope and pushing the sealed envelope onto a horizontal deck for stacking. In order to keep the stacked envelope in an upright position, a stack support is placed on top of the stack. The stack support is urged by a spring disposed on the back side of the stack support against a rear wall of the stacking deck.

This type of bottom stacker requires a large footprint in that the size of the stacker is determined mainly by the size of the stack, and not the size of the mail pieces in the stack.

It is thus advantageous and desirable to provide a method for stacking the mail pieces in a forward serial order without requiring a large stacker footprint. Furthermore, the mail pieces in a stack can be easily unloaded.

SUMMARY OF THE INVENTION

The present invention uses a pair of slotted disks to receive incoming mail pieces one at a time from an input nip. The mail pieces are separately placed in the slots and carried by the rotation of the disks to a stack support in the stacker. The stack support is disposed at a small angle from the vertical axis so that the mail pieces in the stack are kept in the stack by gravity. When a new mail piece is carried in a slot toward the stack support, the lead edge of the mail piece is stopped by a stopping surface. The profile of the slot and the periphery of the disk moves the mail piece in a direction upwardly and substantially perpendicular to the plane of the mail piece after the mail piece has entered the slot so as to allow the entered mail piece to join the bottom of the stack. The addition of a mail piece to the stack lifts the stack by the thickness of the added mail piece. In order to place the slot at an accepting position and to start the disk at an appropriate time, a plurality of sensors are used to coordinate the position of a slot and the movement of an incoming mail pieces.

The present invention will become apparent upon reading the description taken in conjunction with FIGS. 1 to 6.

DETAILED DESCRIPTION OF THE INVENTION

Figure 1A:
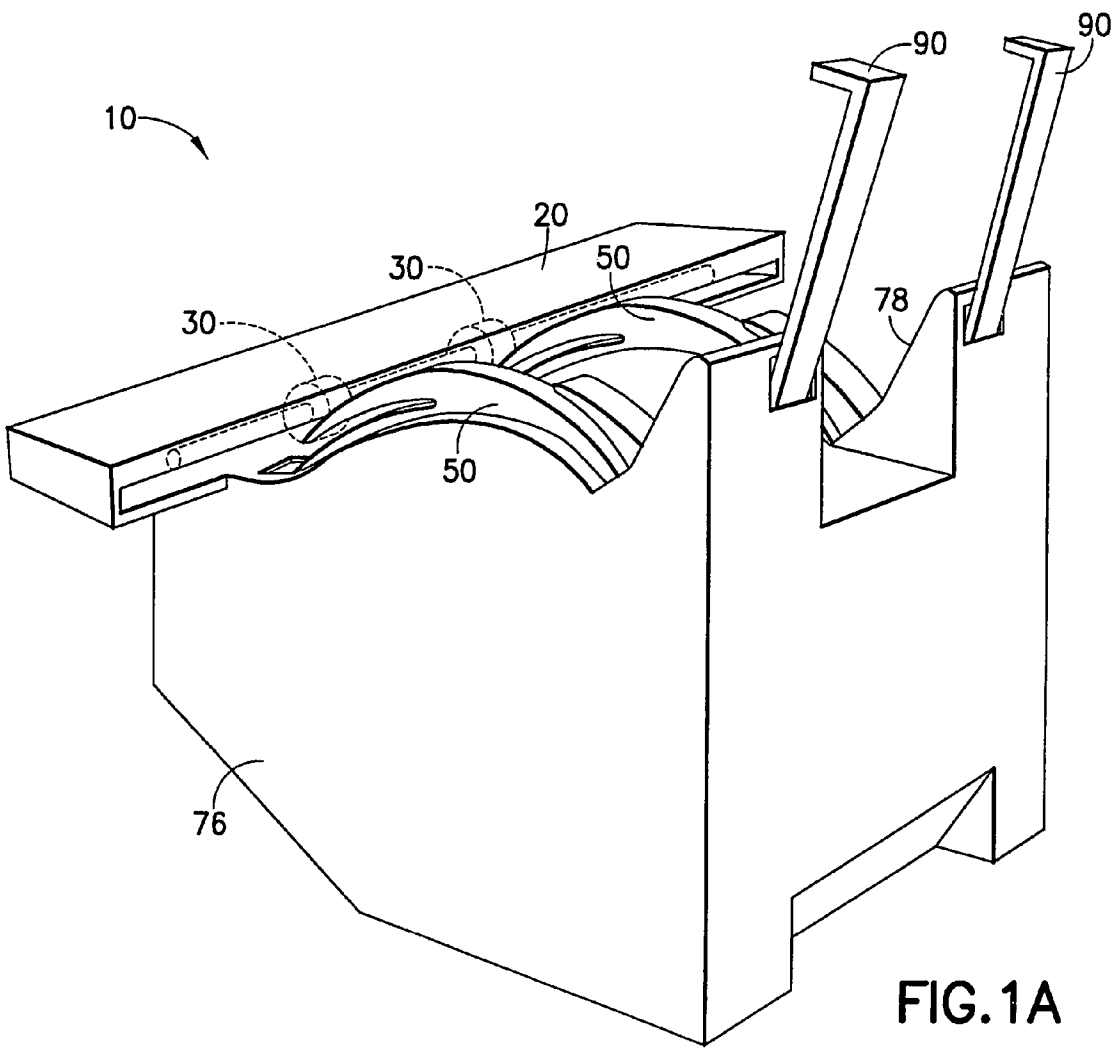
FIG. 1*a* is a perspective view showing the bottom stacker, according to the present invention.
Figure 1B:
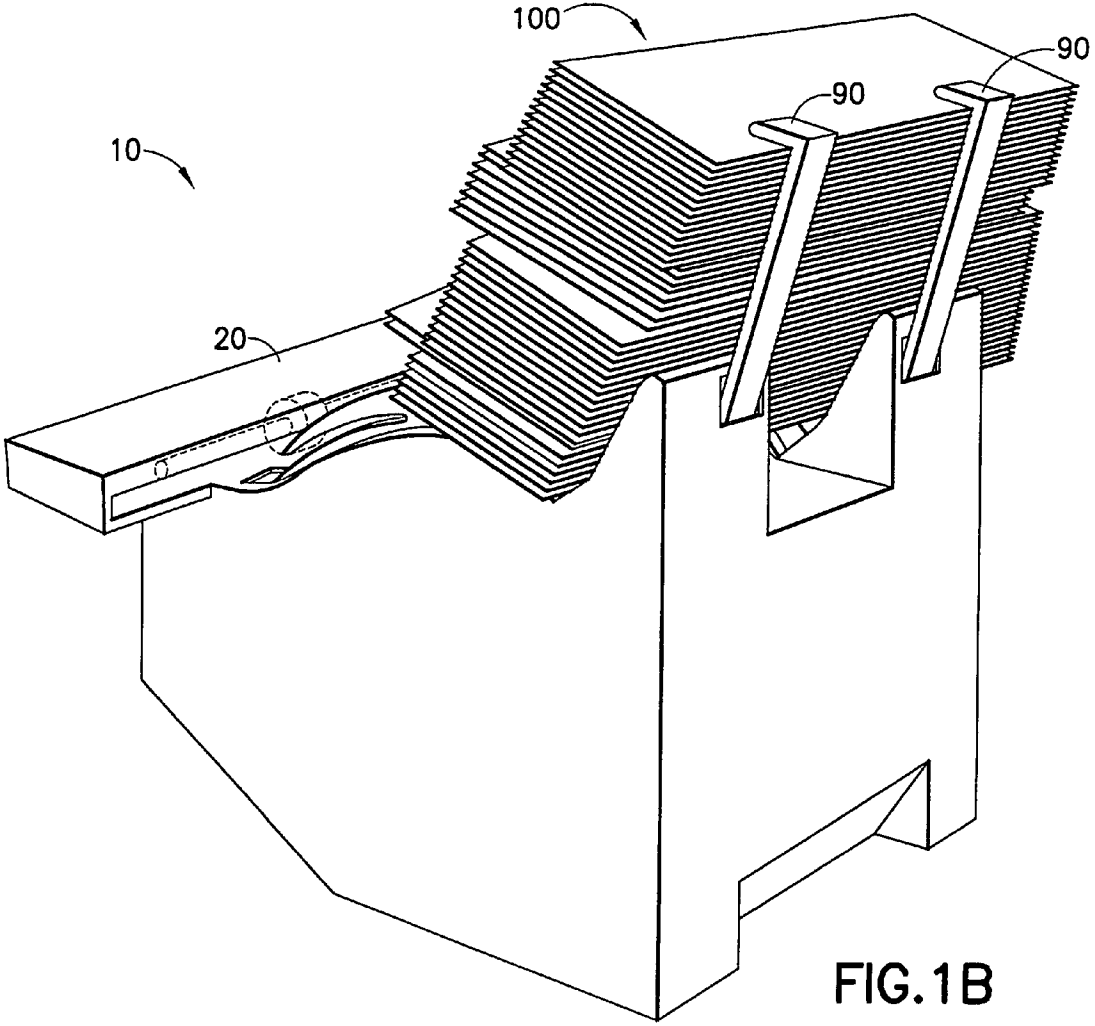
FIG. 1*b* is a perspective view showing the bottom stacker with a stack of mail pieces accumulated thereon.

The bottom stacker, according to the present invention, uses a plurality of slotted disks to accept incoming mail pieces. As shown in FIG. 1*a*, the bottom stacker 10 receives incoming mail pieces through an input guide 20, which has a plurality of rollers 30 to move the mail pieces, one at a time, toward a pair of slotted disks 50. The slotted disks take the incoming mail pieces to the back end of the stacker 10 and stack them against a pair of stack supports 90. FIG. 1*b* shows a stack of mail pieces 100 accumulated against the stack supports on the upper periphery of the disks 50. The stack supports 90 are disposed in a near vertical position. As such, the footprint of the stacker can be very small. Each of the stack supports has an inward extended end to support the top of the stack. The stack supports can be pushed upward by the mail pieces to accommodate a larger stack, if so desired.

Figure 2A:
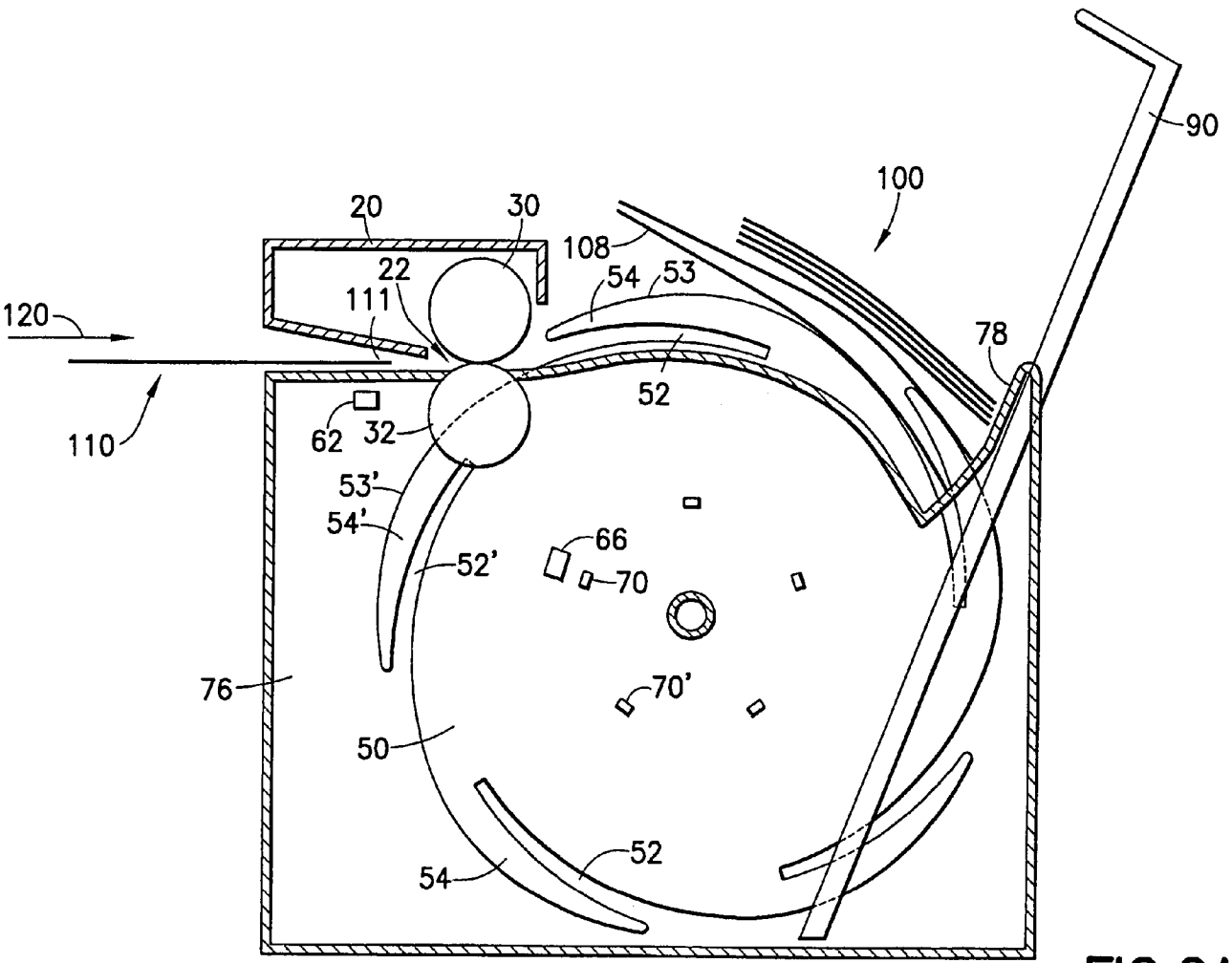
FIG. 2*a* to FIG. 2*e* are cross sectional views of a slotted disk in relation to the stacking position of the stacker showing how an incoming mail piece is stacked.

FIGS. 2*a* to 2*e* show how each incoming mail piece is stacked. It should be noted that any number of substantially identical slotted disks can be used in the bottom stacker. As shown in FIG. 2*a*, an incoming mail piece 110 is moving along a moving direction 120 into the input nip 22 near the input guide 20 above the frame 76 of the stacker. The input nip 22 is a driving nip formed by rollers 30, 32. The slotted disk 50 has at least one and may have a plurality of slots 52, 52' . . . uniformly disposed on the periphery of the disk 50. Each of the slots 52 is associated with a slot arm 54, which is comprised of the outer surface of slot 52 and a surface section 53 of the periphery of disk 50. Depending on the length of the mail piece 110 and the size of the disk 50, the number of the slots 52, 52' . . . can be one to five or greater. In FIGS. 2*a* to 2*e*, the disk 50 is shown to have five slots 52, 52' . . . uniformly distributed on the periphery of the disk 50, such that they are substantially 72° apart from each other. As shown, the disk 50 also has a plurality of taps 70, 70' . . . , each associated with a slot 52, 52' . . . fixedly disposed on the disk 50. A flag sensor 66 is disposed separately from the disk 50 for sensing the arrival of the taps 70, 70' . . . . The bottom stacker 10 has another sensor 62 for sensing the lead edge 111 of an incoming mail piece 110.

Figure 2B:
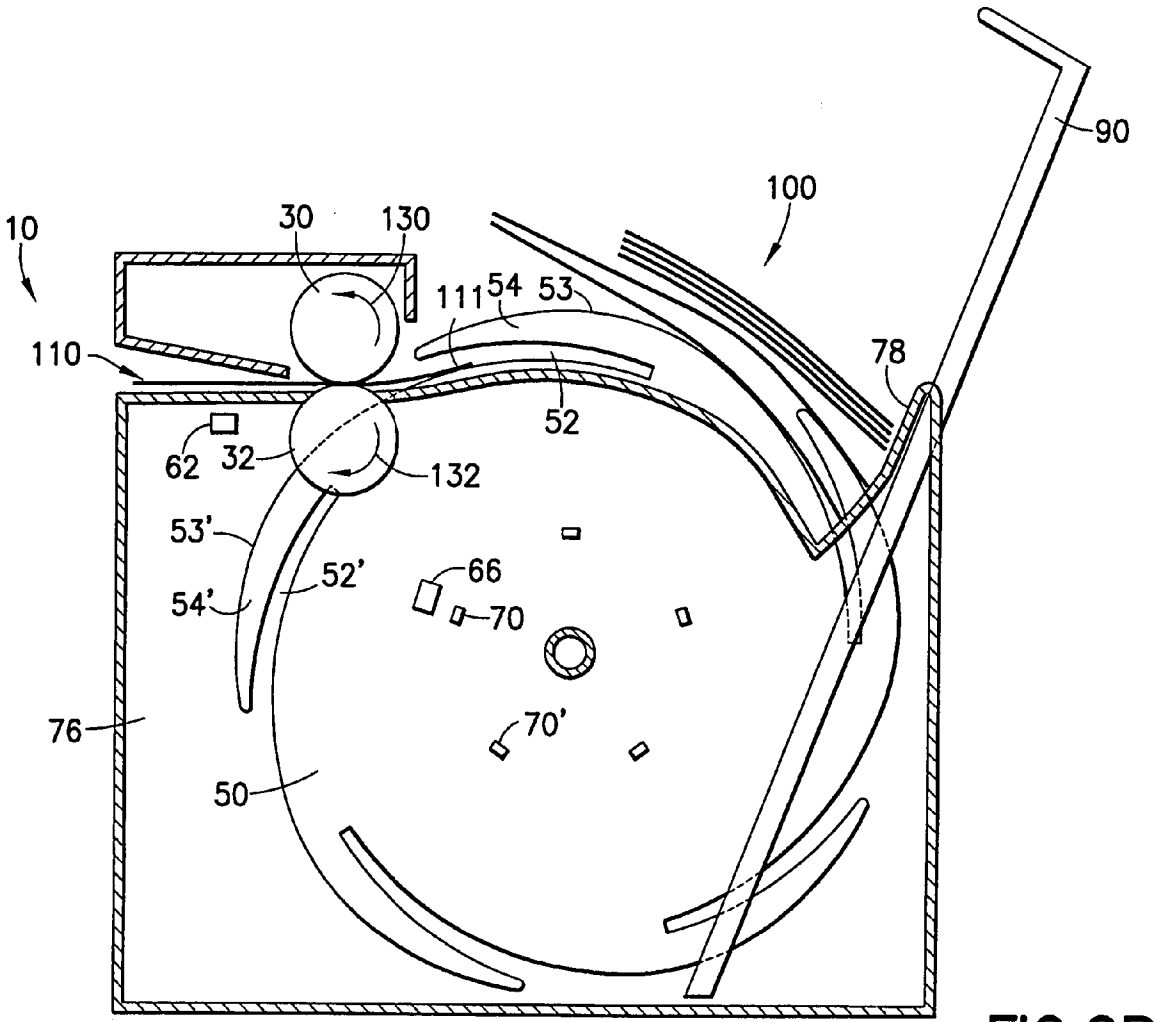
Figure 2C:
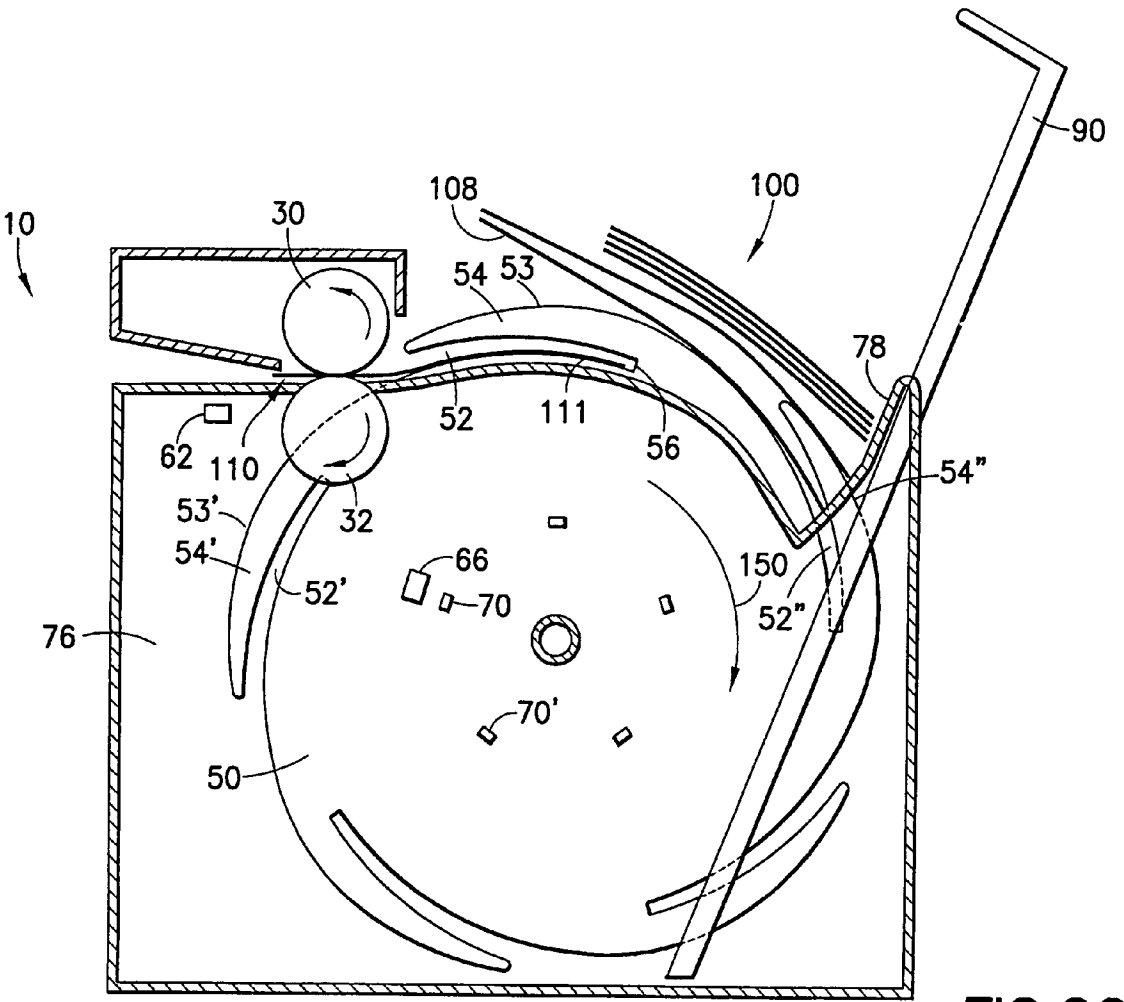
Figure 2D:
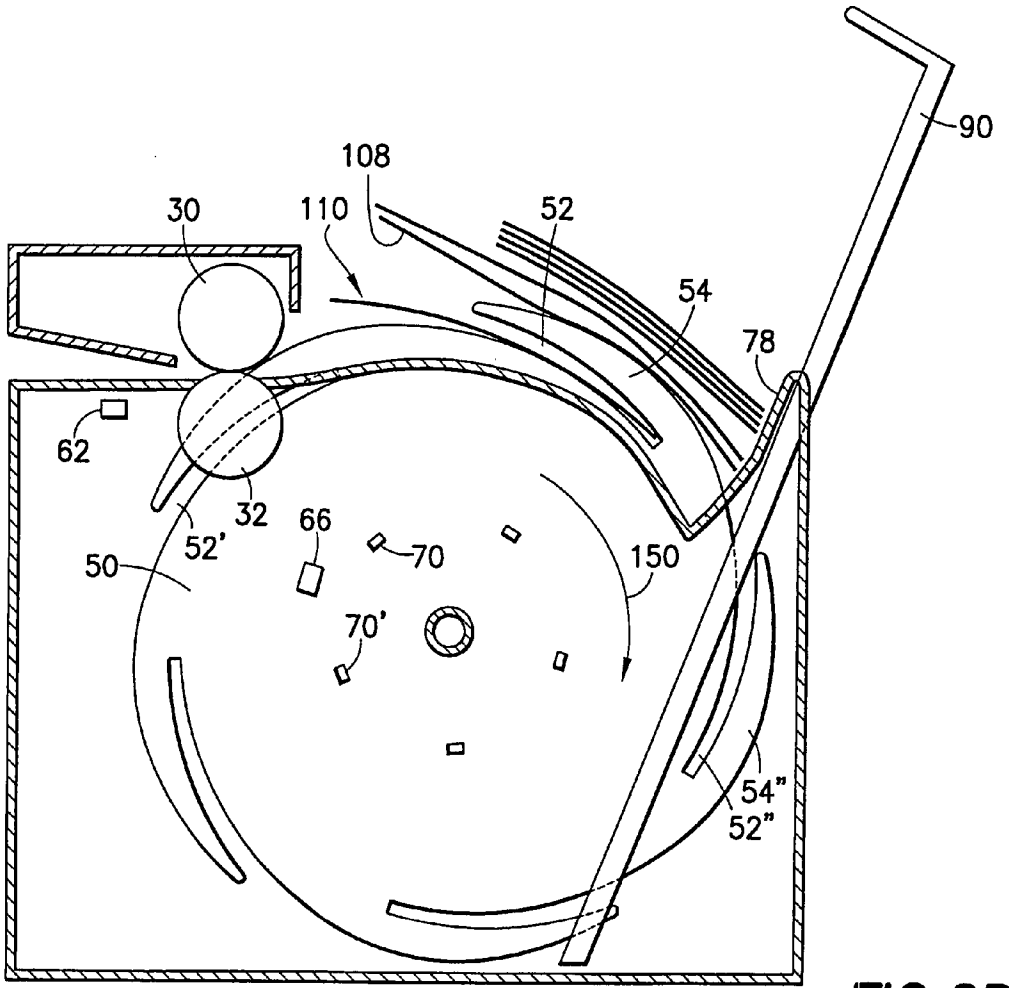
Figure 2E:
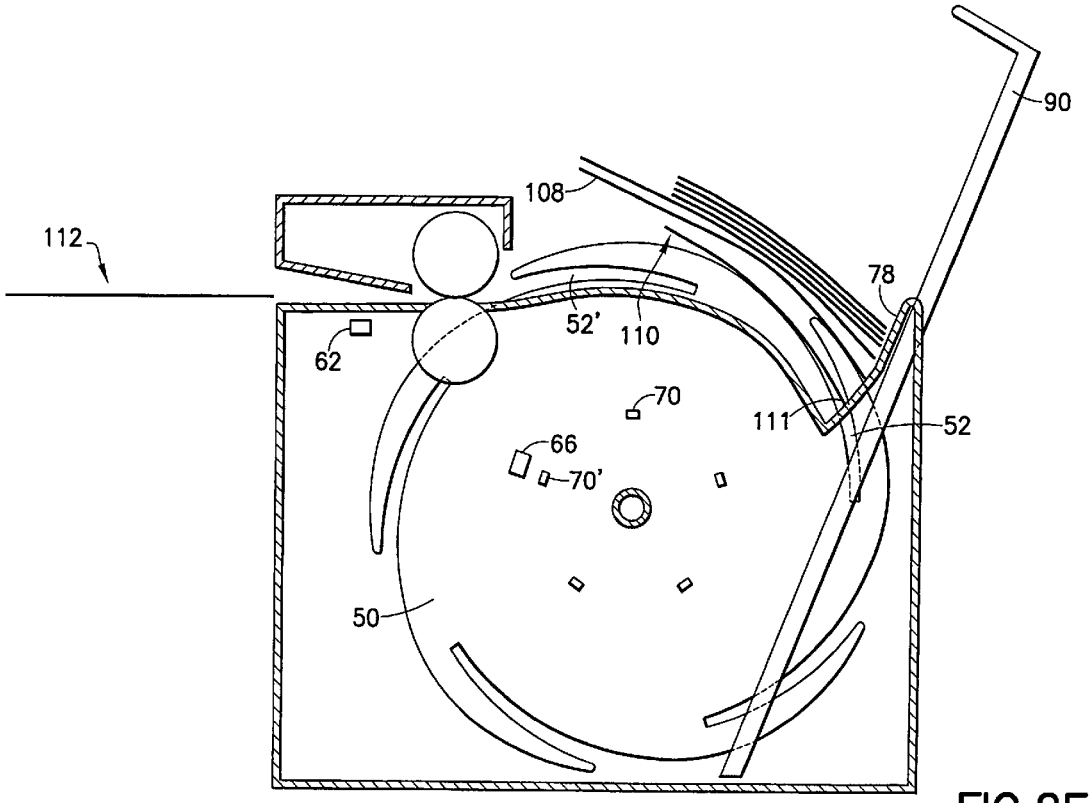

At the beginning of each stacking cycle, the disk 50 is stationary. As shown in FIG. 2*a*, one of the slots 52 is positioned adjacent to the rollers 30, 32, ready to accept the incoming mail piece 110. As the incoming mail piece 110 advances toward the input nip 22, the lead edge 111 of the mail piece 110 is sensed by a sensor 62. After a short period of time (see FIG. 5), the rollers 30, 32 are set in motion in order to drive the mail piece 110 into the accepting slot 52, as shown in FIG. 2*b*. The rotation directions of the rollers 30, 32 are indicated by arrows 130, 132. When the lead edge 111 of the mail pieces substantially reaches the inner extreme 56 of the accepting slot 52, the disk 50 starts to rotate along the rotation direction 150, as shown in FIG. 2*c*. As shown, the preceding mail piece 108 is still in the preceding slot 52" when the disk 50 starts to rotate, but the mail piece 108 is stopped by the stopping surface 78 on the back end of the frame 76. As the disk 50 rotates further, the mail piece 108 is gradually disengaged from the preceding slot 52" and is pushed upward in a direction substantially perpendicular to the plane of the mail piece 110 by the surface section 53 of slot arm 54 of the current slot 52. When the preceding mail piece 108 is completely disengaged from the preceding slot 52", as shown in FIG. 2*d*, it is stacked at the bottom of the accumulated mail in the stack 100. At this point, the mail piece 110 is no longer driven by the rollers 30, 32. It is the forward momentum of the mail piece 110 combined with the friction drag created by the mail piece 110 interacting with the slot geometry and the rotation of disk 50 that carries the mail pieces in the current slot 52 toward stack support 90. Thus, the rollers 30, 32 are no longer required to be in motion. It should be noted that, the tap 70 associated with the current slot 52 is initially positioned near a tap sensor 66, as shown in FIGS. 2*a* to 2*c*. After the disk 50 rotates to carry the mail piece 110 toward the stack support 90, the current tap 70 is moved away from the sensor 66 and the next tap 70' is rotated toward the sensor 66, as shown in FIG. 2*d*. When the next tap 70' reaches the tap sensor 66, the disk 50 stops rotating so as to allow the next slot 52' to accept the next mail piece 112 in the next cycle, as shown in FIG. 2*e*.

Figure 3:
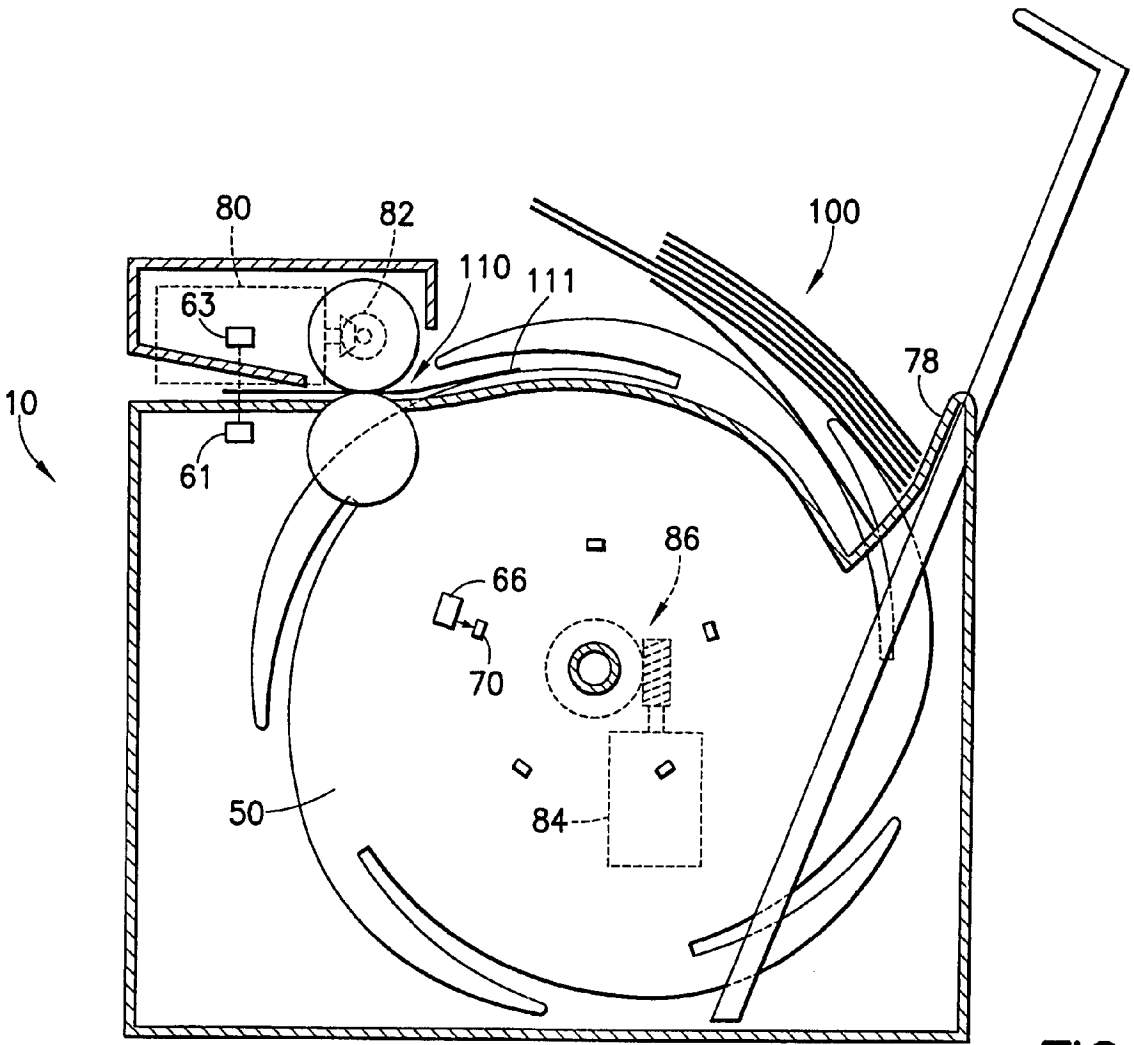
FIG. 3 is a schematic representation showing various movement devices in the bottom stacker.

The movement of the rollers 30, 32 is caused by a roller movement mechanism 80 through a coupling mechanism 82 in FIG. 3. The roller 30 can be a driving roller while the roller 32 can be an idler, for example. As shown in FIG. 3, the roller movement mechanism 80 is a motor and the coupling mechanism 82 is a pair of bevel gears. The movement of the slotted disk 50 is caused by a disk movement mechanism 84 through a coupling mechanism 86. As shown in FIG. 3, the disk movement mechanism 84 is a motor and the coupling mechanism 86 is a pair of worm gears. It will be appreciated that any suitable driving means can be used to rotate nip rollers 30 and 32, and disks 50. Also shown in FIG. 3 is a photo-emitter/detector pair 61, 63 for use as the lead edge sensor 62. As shown, the advancing mail piece 110 blocks the light emitted by the photo-emitter 61 from reaching the photo-detector 63 after the lead edge 111 has reached the sensor location. The tap sensor 66 can be a contact switch, for example, which is caused to close by a tap 70, or a photoemitter-detector pair, or any other suitable sensing device.

Figure 4:
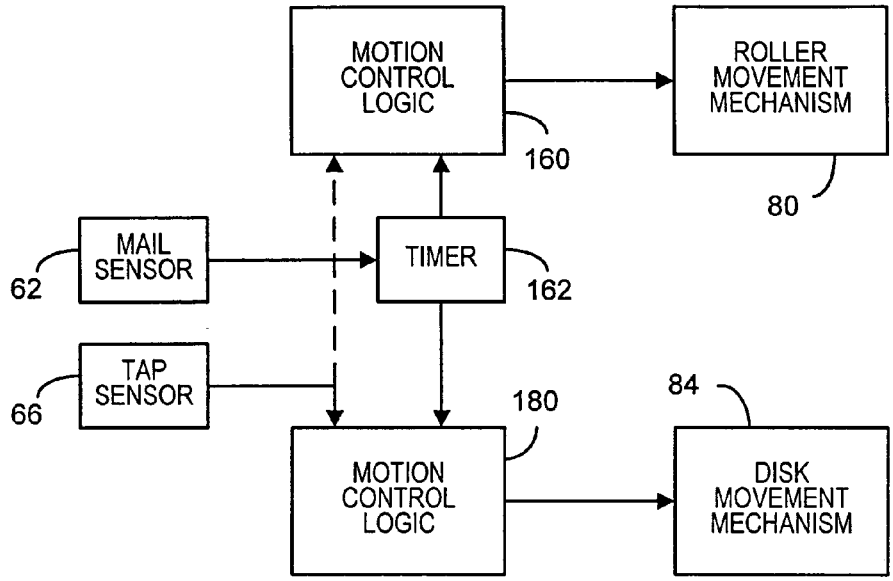
FIG. 4 is a block diagram showing various motion control logic units for controlling the movement devices.
Figure 5:
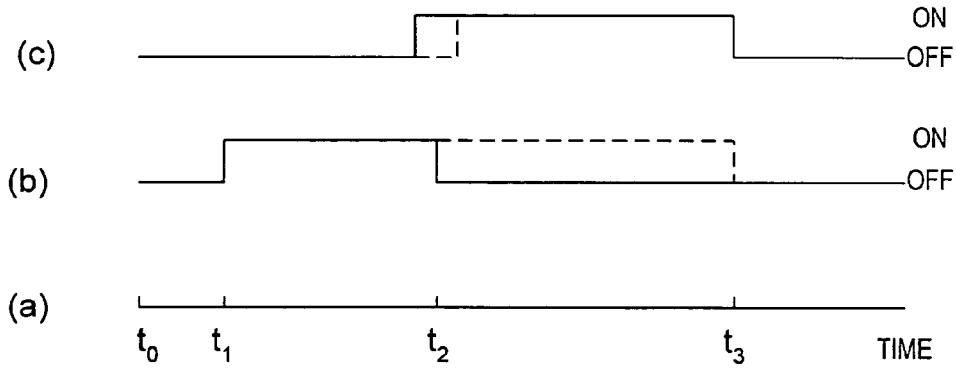
FIG. 5 is a time plot showing the timing of various motion control logic units.

As shown in FIG. 4, the movement of the rollers 30, 32 is controlled by a motion control logic 160. The motion control logic 160 is operatively connected to a timer 162 for timing control, for example. The timer 162 is triggered by the sensor 62 when the sensor 62 senses the lead edge of an advancing mail piece. The timer 162 may be programmed to wait for a short period of time before it activates the motion control logic 160. The wait period is dependent upon the moving speed of the mail piece 110 and the distance between the sensor 62 and the roller nip 22. The timing of the roller movement and that of the slotted disk are shown in FIG. 5. As shown in FIG. 5*a*, the sensing of the lead edge occurs at $t_0$. The motion control logic 160 is set (to an "ON" state) at $t_1$ in order to start the motor 80, thereby causing the rollers 30, 32 to rotate. The wait period between the sensing of the incoming mail piece and the start of the rollers is indicated by the difference between t1 and t0.

After the incoming mail piece has passed the input nip formed by the rollers, the motion control logic 160 can be reset (to an "OFF" state) by the timer 162 at t2, as shown in FIG. 5*b*. For that purpose, the timer 162 is programmed to allow the rollers a time period between t2 and t1 to drive the mail piece into the accepting slot. This time period is set based on the length of the mail piece 110 and the moving speed of the mail piece. In stacking mail pieces of various sizes, this time period should be set based on the longest mail pieces. Alternatively, the drive motor 80 could remain "on" continuously to accept and advance one mail piece after another without turning off, and only being turned off after a suitable time delay during which no mail pieces arrives to be stacked.

The movement of the disk 50 is controlled by another motion control logic 180. As shown in FIG. 4, the motion control logic 180 is also operatively connected to the timer 162. The motion control logic 180 is set by the timer 162 approximately at t2 to start the disk movement mechanism 84, thereby causing the slotted disk to rotate. The time t2 occurs when the lead edge 111 of mail piece 110 arrives at the end 56 of slot 52 (see FIG. 2*c*). The slotted disk keeps rotating until the tap sensor 66 senses the arrival of the next tap 70' (see FIG. 2*e*) at t3. The motion control logic 180 is set and reset as shown in FIG. 5*c*.

It should be noted that after the exit of an incoming mail piece from the roller nip 22 and before the arrival of the next mail piece, whether the rollers are in motion is irrelevant to the stacking process. Thus, it is possible to reset the motion control logic 160 by the tap sensor 66 at t3, as shown in FIG. 5*b*. At this point, the disk and the rollers are stationary, as shown in FIGS. 2*a* and 2*e*. It should also be noted that the motion control logic 160 and the motion control logic 180 are set (to the "ON" state) by the timer 162 at different times after a lead edge is sensed by the sensor 62. If no new lead edge is detected, the disk and the rollers will remain stationary indefinitely.

According to the present invention, the slotted disks in the bottom disk stacker rotate in a sporadic fashion. The disk rotation is triggered by the arrival of each incoming mail piece near the inner extreme of the accepting slot. The disks stop after a fixed number of degrees of rotation, depending on the number of slots on the disks. The rotation of the disks causes each mail piece to exit the accepting slot and move axially outward and upward to be added to the bottom of the accumulated stack.

Disk motion is triggered only by the lead edge of a mail piece arriving at the sensor 62. As such, mail with variable lengths, widths and thicknesses can be stacked with no adjustments required, and no change in the operational sequence.

Figure 6:
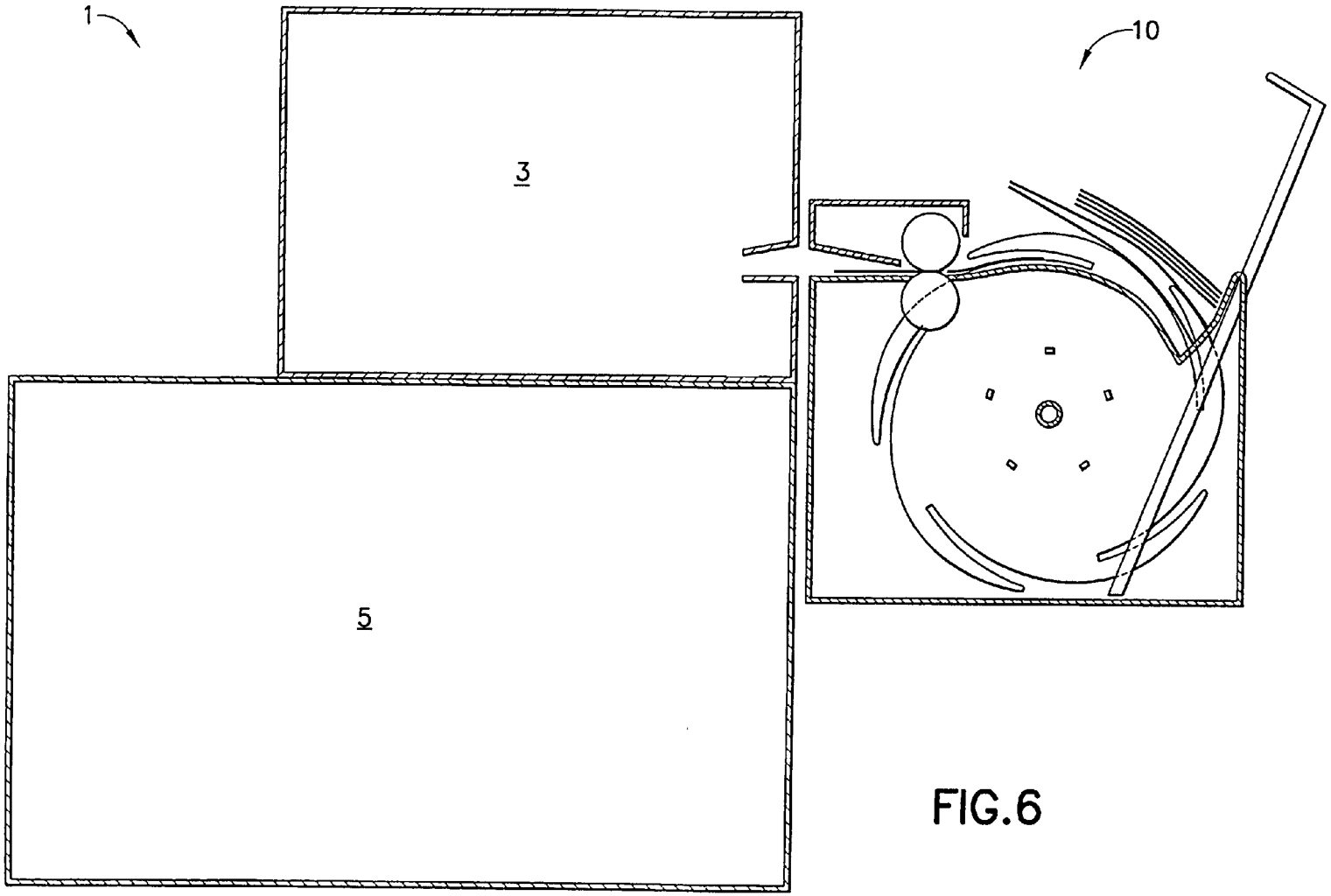
FIG. 6 is a schematic representation of a mailing system showing the relationship between the bottom stacker and other components in the mailing system.

The bottom disk stacker 10, according to the present invention, can be integrated into a mailing system. For example, in a mailing system for mail piece addressing and inserting, the bottom disk stacker keeps the mail pieces in a forward serial order. FIG. 6 is a schematic representation of such a mailing system. As shown, the mailing system 1 comprises an inserting station 5 where documents are inserted into envelopes. After the envelopes are sealed, addresses may be printed on the sealed envelopes in a printer 3. Alternatively, addresses could be printed on the envelopes prior to inserting the contents into the envelope, or windowed envelopes could be used so that an address printed on the contents is visible through the window after the contents are inserted in the envelope. In this example, the addressed envelopes are the mail pieces to be stacked by the bottom disk stacker 10, according to the present invention. However, the mailing system can be a mail-sorting machine that sorts the mail pieces according to the zip codes, for example. Moreover, the bottom disk stacker can be used to accumulate any stackable materials.

The advantages of the bottom disk stacker, according to the present invention, include the following features:

- high capacity in a very small footprint
- unload-while-run
- able to stack intermixed sizes with no adjustments required, either manually or automatically
- paper path being skew tolerant
- accumulated stack supported near middle of stack to prevent sagging
- relatively few piece parts, actuators and sensors.

The stacker as shown in FIGS. 1*a* and 1*b* has two slotted disks. However, it is possible to use three or more slotted disks in a stacker. The tap sensor as shown in FIG. 3 is a contact switch. However, other types of sensor can also be used to sense the arrival of the next tap. Furthermore, the number of slots on each slot disks can be one to five or greater, depending on the length of the stackable materials and the size of the disks.

Furthermore, one skilled in the art would be able to appreciate that it is also possible to use, instead of two or more slotted disks 50, a single cylindrical body having one or more slots to receive incoming mail pieces for stacking. Moreover, two stopping surfaces 78 can be positioned outside a pair of slotted disks 50 to disengage the mail piece in an accepting slot. Alternatively, a single stopping surface can be positioned between two slotted disks for carrying out the same task.

The bottom stack of the present invention can be used to stack mail pieces having one uniform size and shape. It can also be used to stack mail pieces or stackable items having various lengths, widths and thicknesses.

Furthermore, it is possible to have only one tap 70 on the disk 50 even when there are two or more slots 52. In that case, the tap 70 is used to position the slot to receive the first mail piece to be stacked. After the disk is rotated for a predetermined rotational angle for stacking the mail piece, the disk is programmed to pause in order to receive a subsequent mail piece.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method of adding stackable items, one at a time, to the bottom of a stack in a stacker, wherein the stackable items have a moving direction toward the stacker, said method comprising the steps of:

providing at least one rotational element rotatable about a rotational axis, the rotational axis substantially perpendicular to the moving direction of the stackable items, the at least one rotational element having an outer peripheral surface wherein the at least one rotational element has at least one slot breaking into the outer peripheral surface and dimensioned for receipt of one stackable item at a time;

providing a stopping surface positioned in relationship to the at least one rotational element;

causing at least a portion of a stackable item to enter into one of the at least one slot in the at least one rotational element;

rotating the at least one rotational element toward the stopping surface so as to disengage the stackable item that has been entered into the slot of the at least one rotational element and to cause a section of the outer peripheral surface of the at least one rotational element to engage an underside surface of the stack, lift the stack upward and deposit the stackable item at the bottom of the stack;

wherein the stackable item is caused to enter into the slot by a driving mechanism when the at least one rotational element is stationary, said method further comprising the step of providing an input sensing device positioned in relationship with the driving mechanism for sensing when the stackable item is in a position suitable for receipt by the at least one slot at a point relative to the driving mechanism so as to start said rotating after a period of time based on said sensing; and wherein said rotating is paused after a further finite period of time so as to allow a subsequent stackable item to enter the subsequent one of the at least one slot in the at least one rotational element.

2. The method of claim 1, wherein the driving mechanism is positioned in relationship to the slot for driving the stackable item into the slot at a moving speed, and wherein said period of time is calculated at least based on the distance between the driving mechanism and the slot, and the moving speed of the stackable item.

3. The method of claim 1, wherein the subsequent stackable item enters the subsequent one of the at least one slot when said subsequent slot is stationary at a receiving position, said method further comprising the step of disposing a position sensing means in relationship to the subsequent one of the at least one slot to cause said pausing when the subsequent one slot reaches the receiving position.

4. The method of claim 2, wherein the position sensing means comprises at least one positioning flag disposed to rotate with the at least one rotational element and a sensor for sensing the arrival of one of the at least one positioning flag.

5. The method of claim 1, wherein said rotating is paused after a predetermined degree of rotation so as to allow a subsequent stackable item to enter the subsequent one of the at least one slot in the at least one rotational element.

* * * * *